US011439556B2

(12) United States Patent
Okudaira

(10) Patent No.: US 11,439,556 B2
(45) Date of Patent: Sep. 13, 2022

(54) EXAMINATION TABLE

(71) Applicant: Tadahiro Okudaira, Okinawa (JP)

(72) Inventor: Tadahiro Okudaira, Okinawa (JP)

(73) Assignee: Okudaira Tadahiro, Okinawa (JP)

( * ) Notice: Subject to any disclaimer, the term of this patent is extended or adjusted under 35 U.S.C. 154(b) by 0 days.

(21) Appl. No.: 17/134,160

(22) Filed: Dec. 24, 2020

(65) Prior Publication Data

US 2021/0113405 A1 Apr. 22, 2021

Related U.S. Application Data

(63) Continuation of application No. PCT/JP2019/043157, filed on Nov. 1, 2019.

(30) Foreign Application Priority Data

Nov. 2, 2018 (JP) ..... JP2018-207727

(51) Int. Cl.
*A61G 13/04* (2006.01)
*A61G 13/00* (2006.01)
(Continued)

(52) U.S. Cl.
CPC ..... *A61G 13/0009* (2013.01); *A61G 13/04* (2013.01); *A61G 13/08* (2013.01);
(Continued)

(58) Field of Classification Search
CPC .... A61G 13/0009; A61G 13/04; A61G 13/08; A61G 13/105; A61G 13/1225;
(Continued)

(56) References Cited

U.S. PATENT DOCUMENTS 6,256,817 B1 * 7/2001 McGuire ..... A61G 15/005 297/354.13
6,755,463 B2 * 6/2004 Lardieri ..... A47C 1/035 297/35
2009/0021063 A1 1/2009 Morita

FOREIGN PATENT DOCUMENTS

CN 101347381 A 1/2009
CN 207654389 U 7/2018
(Continued)

OTHER PUBLICATIONS (ISA/237) Written Opinion of the International Search Authority for International Patent Application No. PCT/JP2019/043157, issued/mailed by the Japan Patent Office dated Dec. 17, 2019.
(Continued)

*Primary Examiner* — Fredrick C Conley

(57) ABSTRACT

An examination table that can be used in other places than a hospital is provided. A portable examination table comprises a seat part for supporting a bottom of a patient, an angle-changeable backrest part for supporting a back of the patient, a pair of angle-changeable arm parts, abutting parts configured to be raised or lowered when the angle of the arm parts relative to the seat part is changed and abut the back of the knees of the patient, and link parts configured to link the arm parts to the backrest part and change the angle of the arm parts, and is configured to convert between an end-sitting positioning state, a lithotomy positioning state, and a folded state.

8 Claims, 11 Drawing Sheets

(51) Int. Cl.

| | |
|---|---|
| ***A61G 13/08*** | (2006.01) |
| ***A61G 13/10*** | (2006.01) |
| ***A61G 13/12*** | (2006.01) |

(52) U.S. Cl.
CPC ..... *A61G 13/101* (2013.01); *A61G 13/105* (2013.01); *A61G 13/123* (2013.01); *A61G 13/1225* (2013.01); *A61G 13/1245* (2013.01); *A61G 2200/12* (2013.01); *A61G 2200/327* (2013.01); *A61G 2200/34* (2013.01)

(58) Field of Classification Search
CPC ..... A61G 13/123; A61G 13/101; A61G 13/1245; A61G 2200/12; A61G 2200/327; A61G 2200/34

See application file for complete search history.

(56) References Cited

FOREIGN PATENT DOCUMENTS

| | | | |
|---|---|---|---|
| JP | S58105322 | U | 7/1983 |
| JP | H01178736 | U | 12/1989 |
| JP | 2011183145 | A | 9/2011 |
| JP | 2014064811 | A | 4/2014 |
| JP | 3198381 | U | 7/2015 |
| WO | 2012152358 | A1 | 11/2012 |

OTHER PUBLICATIONS

Office Action issued for counterpart Japanese Application No. 2018-207727, issued by the Japan Patent Office dated Sep. 24, 2029 (drafted on Sep. 13, 2019).
Notice of First Office Action for Patent Application No. 201980042893.7, issued by The National Intellectual Property Administration of the People's Republic of China dated Apr. 15, 2022.

* cited by examiner

EXAMINATION TABLE

The contents of the following Japanese and International patent applications are incorporated herein by reference:

Application Number 2018-207727 filed on Nov. 2, 2018; and

Application Number PCT/JP2019/043157 filed on Nov. 1, 2019.

BACKGROUND

1. Technical Field

The present invention relates to an examination table.

2. Related Art

A medical treatment is performed while a patient is placed on an examination table that has a special structure, from a viewpoint of position-keeping of the patient, sanitation control or the like (for example, see Patent Document 1).

Patent Document 1: Japanese Patent Application Publication No. 2014-064811

SUMMARY

An examination table has a structure and size for installation and use in a specialized facility such as a hospital or the like. Therefore, at a site of an accident, a disaster or the like, or at a home birth or the like, a medical treatment may be forced to be performed without use of an examination table. In such case, it may be more difficult to perform an operation or the sanitation control level may be lowered.

In one aspect of the present invention, a portable examination table may include a seat part for supporting a bottom of a patient, the seat part being positioned relative to a floor by a leg part including a plurality of legs. The portable examination table may include a backrest part for supporting a back of the patient, the backrest part being provided at one end of the seat part and capable of changing an angle relative to the seat part. The portable examination table may include a pair of arm parts capable of changing an angle relative to the seat part, the pair of arm parts being provided at another end of the seat part avoiding the front of the patient leaning his/her back against the backrest part. The portable examination table may include abutting parts configured to couple end portions of the pair of arm parts at farther ends from the seat part, and to be raised or lowered when the angle of the pair of arm parts relative to the seat part is changed and abut the back of the knees of the patient when raised. The portable examination table may include link parts configured to, when the angle of the backrest part relative to the seat part is changed, link the pair of arm parts with the backrest part and change the angle of the pair of arm parts relative to the seat part. The portable examination table may convert between an end-sitting positioning state in which the backrest part is erected relative to the seat part so that the patient seated on the seat part is in an end-sitting position, a lithotomy positioning state in which the backrest part is reclined and the abutting parts lifted by the pair of arm parts linked with the backrest part via the link parts lift the back of the knees of the patient, so that the patient is in a lithotomy position, and a folded state in which the angle between the seat part and the backrest part is smaller than the end-sitting positioning state so that the entire dimension of the examination table is smaller than that in the end-sitting positioning state. The portable examination table may further include a linkage configured to, when the examination table is converted to the folded state, narrow at least part of a gap between the plurality of legs and reduce the dimension of entire leg part compared to that in the end-sitting positioning state and the lithotomy positioning state. In at least one of the seat part and the backrest part, a portion for contacting with a body of the patient may be detachable. At least one of the seat part and the backrest part may have a frame part surrounding a region for contacting with the body of the patient. The at least one of the seat part and the backrest part may have a sheet detachably stretched across the frame part. The portable examination table may further include an attachment part for attaching a medical peripheral.

The summary clause does not necessarily describe all necessary features of the embodiments of the present invention. The present invention may also be a sub-combination of the features described above.

DESCRIPTION OF EXEMPLARY EMBODIMENTS

Hereinafter, some embodiments of the present invention will be described. The following embodiments do not limit the invention according to the claims. All the combinations of the features described in the following embodiments are not necessarily essential to means provided by aspects of the invention.

Figure 1:
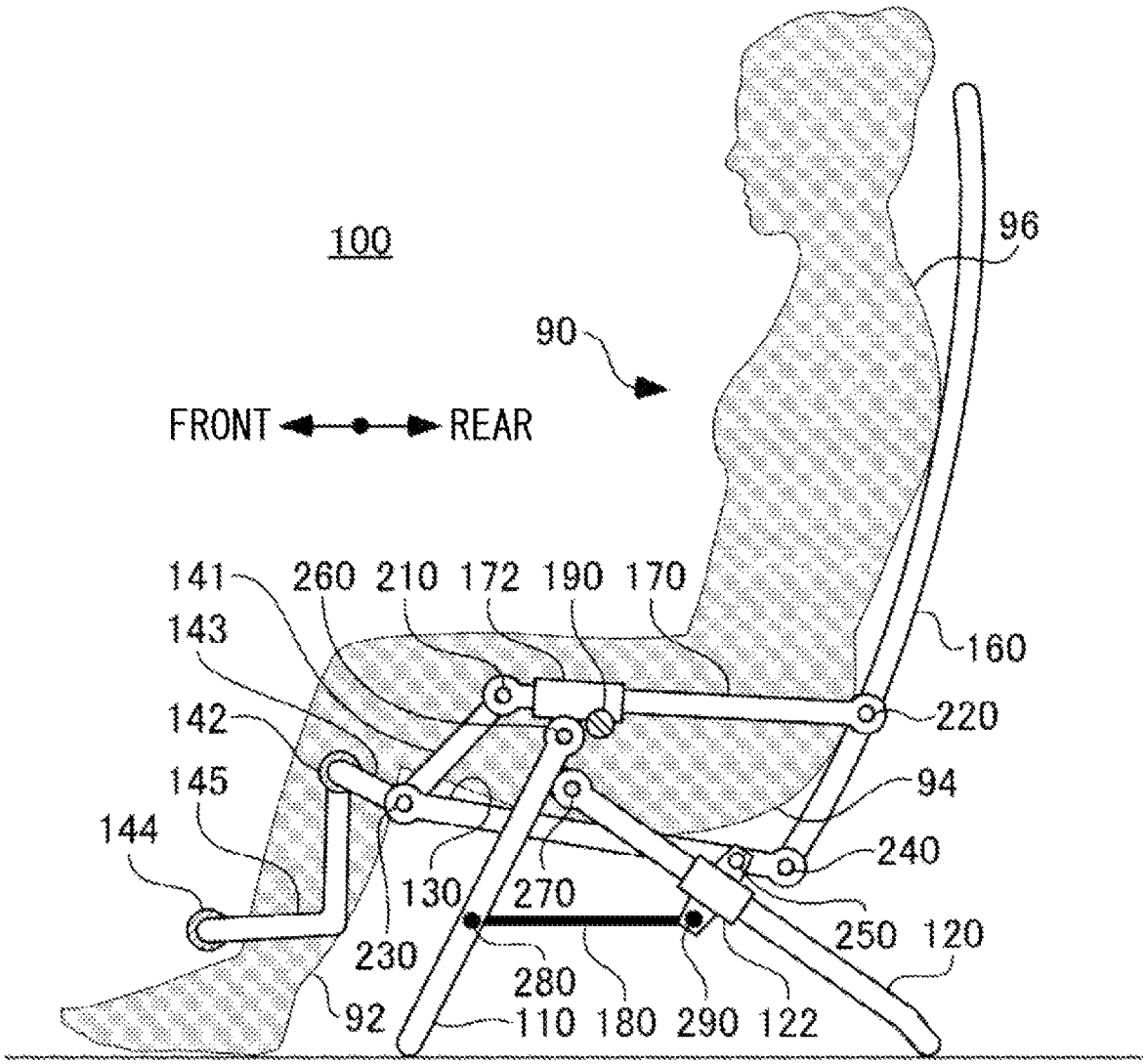
FIG. 1 is a side view of an examination table 100.

FIG. 1 is a side view of an examination table 100. The examination table 100 shown in FIG. 1 is in an end-sitting positioning state for supporting a patient 90 in an end-sitting position.

The examination table 100 for supporting a patient 90 includes a front leg 110, a rear leg 120, a seat 130, arm parts 143, joint parts 145, a backrest 160, upper links 170, lower links 180, and brakes 190. Note that, as indicated by arrows in the figures, in the following description, the ventral side of the patient 90 placed on the examination table 100 will be described as "front" and the dorsum side of the patient 90 is will be described as "rear".

The front leg 110 and the rear leg 120 are for contacting with the floor at their lower ends (in the figure), and position the examination table 100 relative to a floor. An upper end of the front leg 110 is connected to an upper link 170 via an upper slider 172. A joint 260 rotatably connects the front leg 110 and the upper slider 172. The upper slider 172 can have the upper link 170 inserted therethrough and be moved along the upper link 170.

Note that the upper slider 172 includes a brake 190, so that when the brake 190 is actuated the upper slider 172 can be fixed in any position relative to the upper link 170. When the upper slider 172 is fixed relative to the upper link 170 by the brake 190, the upper link 170 is positioned and supported by the front leg 110 coupled via the joint 260 of the upper slider 172.

An upper end of the rear leg 120 is rotatably coupled to the front leg 110 by a joint 270. The rear leg 120 is provided with a lower slider 122. The lower slider 122 is moveable along the rear leg 120. The lower slider 122 is rotatably connected to the lower link 180 by a joint 290. Further, the lower link 180 is rotatably coupled to the mid part of the front leg 110 via a joint 280. Thus, when the rear leg 120 is rotated relative to the front leg 110 around the joint 270, the lower slider 122 is moved along the rear leg 120.

Moreover, the lower slider 122 is rotatably connected to the side surface of the seat 130 via a joint 250. A position of the lower slider 122 relative to the rear leg 120 is positioned by the lower link 180, so that the seat 130 is positioned and supported by the rear leg 120 at least at the position of the joint 250.

A front end of the seat 130 and a front end of the upper link 170 are connected by a front link 141 rotatably via joints 230, 210 respectively. The front link 141 is integrally connected to the arm part 143 extending in a direction of extending the seat 130 forward. Further, a horizontal bar 142 is provided at a front end of the arm part 143. The horizontal bar 142 is covered by an elastic material. When the front link 141 is rotated about the joints 210, 230, the arm part 143 is also rotated with the front link 141. Further, the horizontal bar 142 is raised or lowered with the front end of the arm part 143.

A rear end of the seat 130 and a rear end of the upper link 170 are connected to a backrest 160 rotatably via joints 220, 240, respectively. The backrest 160 extends further upward from the joint 220.

As for the examination table 100 in a state shown in FIG. 1, an angle between the front leg 110 and the rear leg 120 is fixed at a predetermined angle by the length of the lower link 180. The joint 250 near the rear end of the seat 130 is positioned by the rear leg 120 via the lower slider 122. Moreover, the seat 130 is supported by the front leg 110 via the upper slider 172, the upper link 170, the front link 141 and the backrest 160.

As for the examination table 100 shown in FIG. 1, the position of the upper slider 172 relative to the upper link 170 is fixed by the brake 190, so that the seat 130 is positioned relative to the floor. Thus, a bottom 94 of the patient 90 is stably supported. Moreover, the relative positions of the upper link 170 and the seat 130 is fixed, so that the position and inclination of the backrest 160 are also fixed. Thus, the examination table 100 can support the back 96 of the patient 90 and hold the position of the patient 90.

Figure 2:
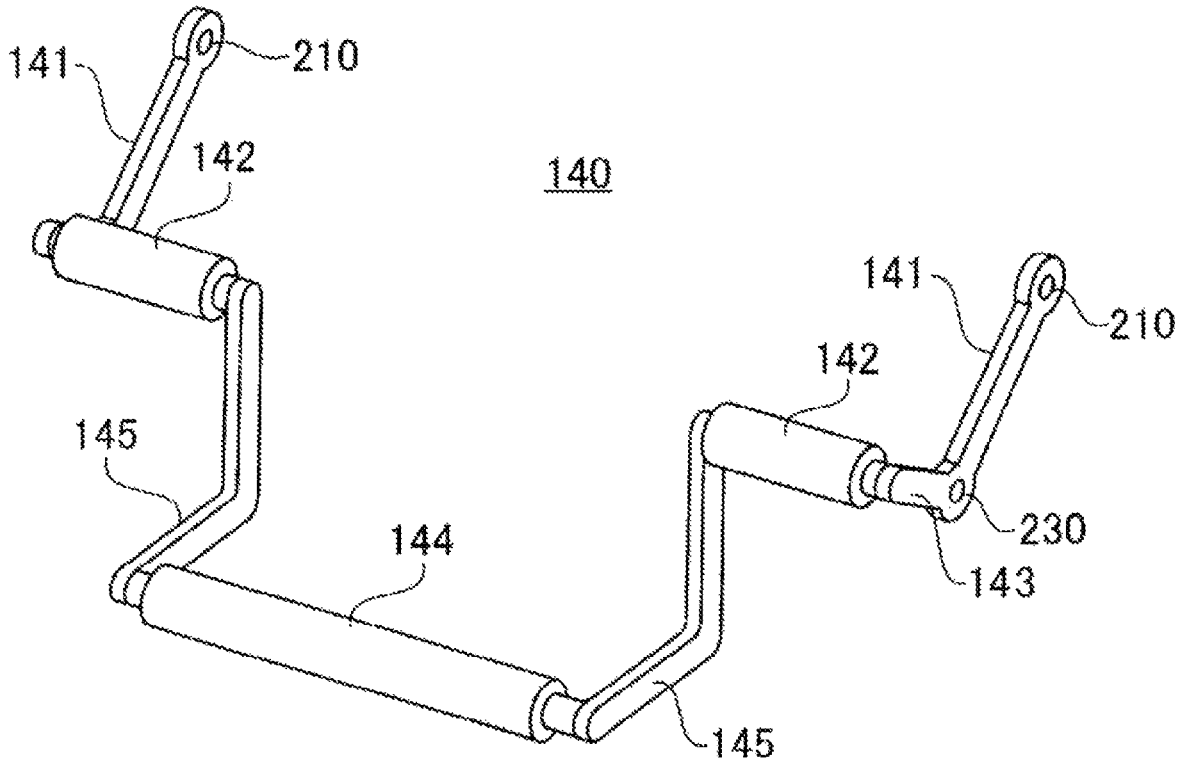
FIG. 2 is a perspective view of a front assembly 140.

FIG. 2 is a perspective view of a front assembly 140. The front assembly 140 is a member integrating front links 141, horizontal bars 142, 144, arm parts 143, and joint parts 145 positioned on the front side of the examination table 100.

In the front assembly 140, each of the front links 141 have a straight portion and a portion provided at the both ends of the straight portion for forming a part of the joints 210, 230. Each of the arm parts 143 is connected to a lower end (in the figure) of each of the front links 141 and protrudes forward from the examination table 100. The front ends (in the figure) of the arm parts 143 are connected to a pair of horizontal bars 142.

One end of each of the pair of horizontal bars 142 is connected substantially at a right angle to the arm part 143, and each of the pair of horizontal bars 142 extends inward of the front assembly 140. Moreover, other ends of the pair of horizontal bars 142 are connected by another single horizontal bar 144 via joint parts 145. Each of the horizontal bars 142, 144 is covered by an elastic buffer material.

In an end-sitting positioning state shown in FIG. 1, each of the joint parts 145 extends downward from an end of the upper (in the figure) horizontal bar 142, then bends substantially at a right angle and extends forward to put the lower (in the figure) horizontal bar 144 forward. Thus, a gap is formed between the horizontal bar 144 and the seat 130 into which lower limbs of the patient 90 can be inserted.

Figure 3:
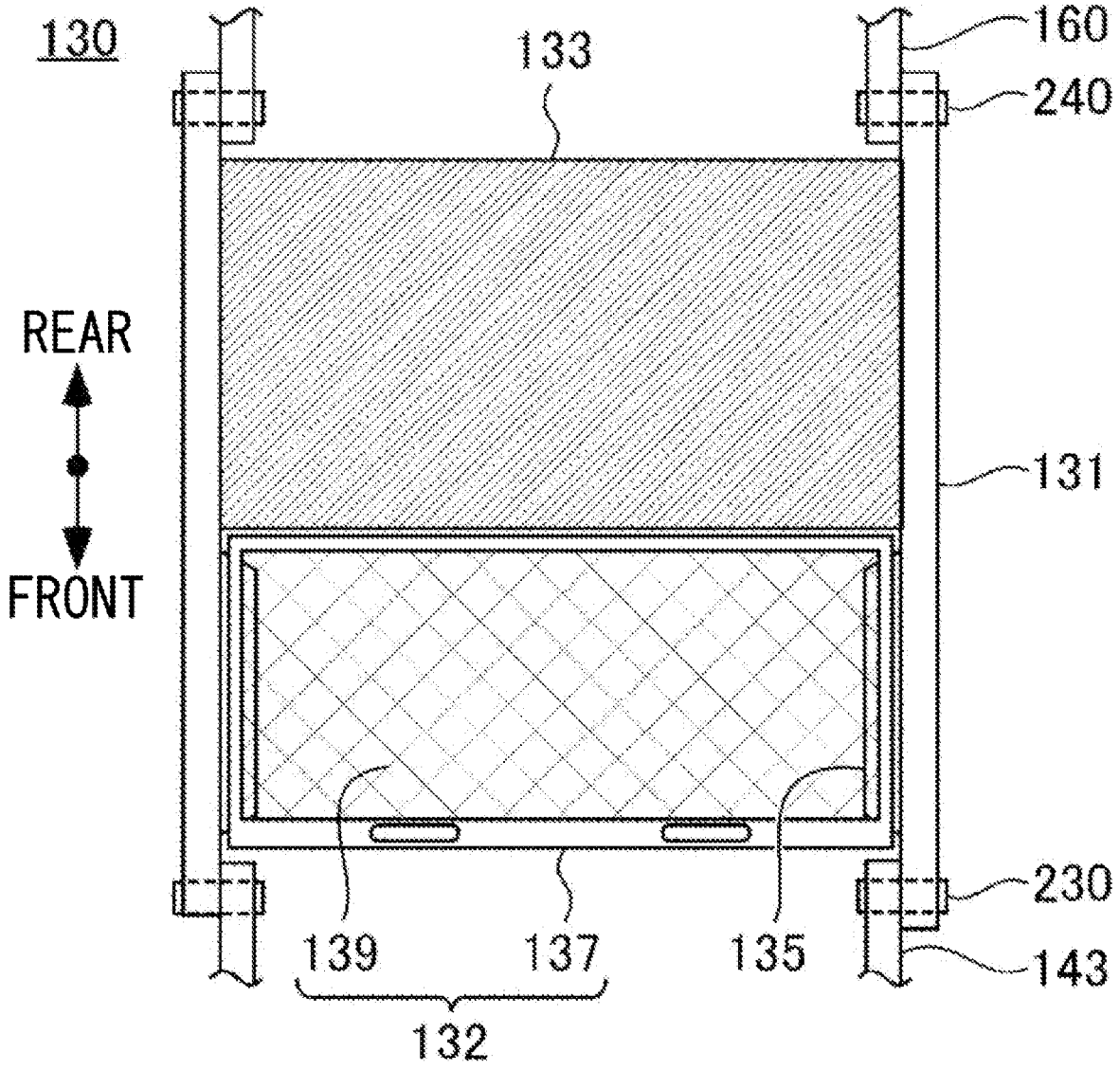
FIG. 3 is plan view of a seat 130.

FIG. 3 is a plan view of a seat 130 of the examination table 100. The seat 130 has frames 131, a detachable seat part 132, and a fixed seat part 133.

The pair of frames 131 are formed of a high-strength material such as a metal tube material, and are provided on both sides of the seat 130. A front end of each of the frames 131 is connected to the arm part 143 via the joint 230. A rear end of each of the frames 131 is connected to the backrest 160 via the joint 240.

The fixed seat part 133 and the detachable seat part 132 are provided between the pair of frames 131. The fixed seat part 133 is directly fixed to the frames 131. On the other hand, the detachable seat part 132 has its own detachable frame 137 and a cushion part 139 supported by the detachable frame 137. The detachable frame 137 is placed on a support rib 135 provided inside of the frames 131 and can be removed from the frames 131.

In the seat 130, the fixed seat part 133 and the detachable seat part 132 together form a seat with a wide surface area. Thus, when the examination table 100 is in the end-sitting positioning state as shown in FIG. 1, the patient 90 supported on the examination table 100 is supported by the seat 130 from his/her bottom 94 to thighs.

When the examination table 100 having such structure as described above is in the end-sitting positioning state, as shown in FIG. 1, the examination table 100 is in the state for the end-sitting position in which the backrest 160 is erected at an angle that is close to the perpendicular relative to the seat 130 slightly inclined rearward. The bottom 94 of the patient 90 is placed on the seat, and the patient 90 is leaning his/her back against the upright backrest 160. Moreover, the lower limbs 92 of the patient 90 are positioned between the horizontal bar 144 and the seat 130, and the body position of the patient 90 is the end-sitting position. Thus, the patient 90 can receive a medical check of the upper abdomen, chest, neck or the like by auscultation, palpation, percussion or the like in the end-sitting position and, besides, can be treated by injection, infusion or the like.

Figure 4:
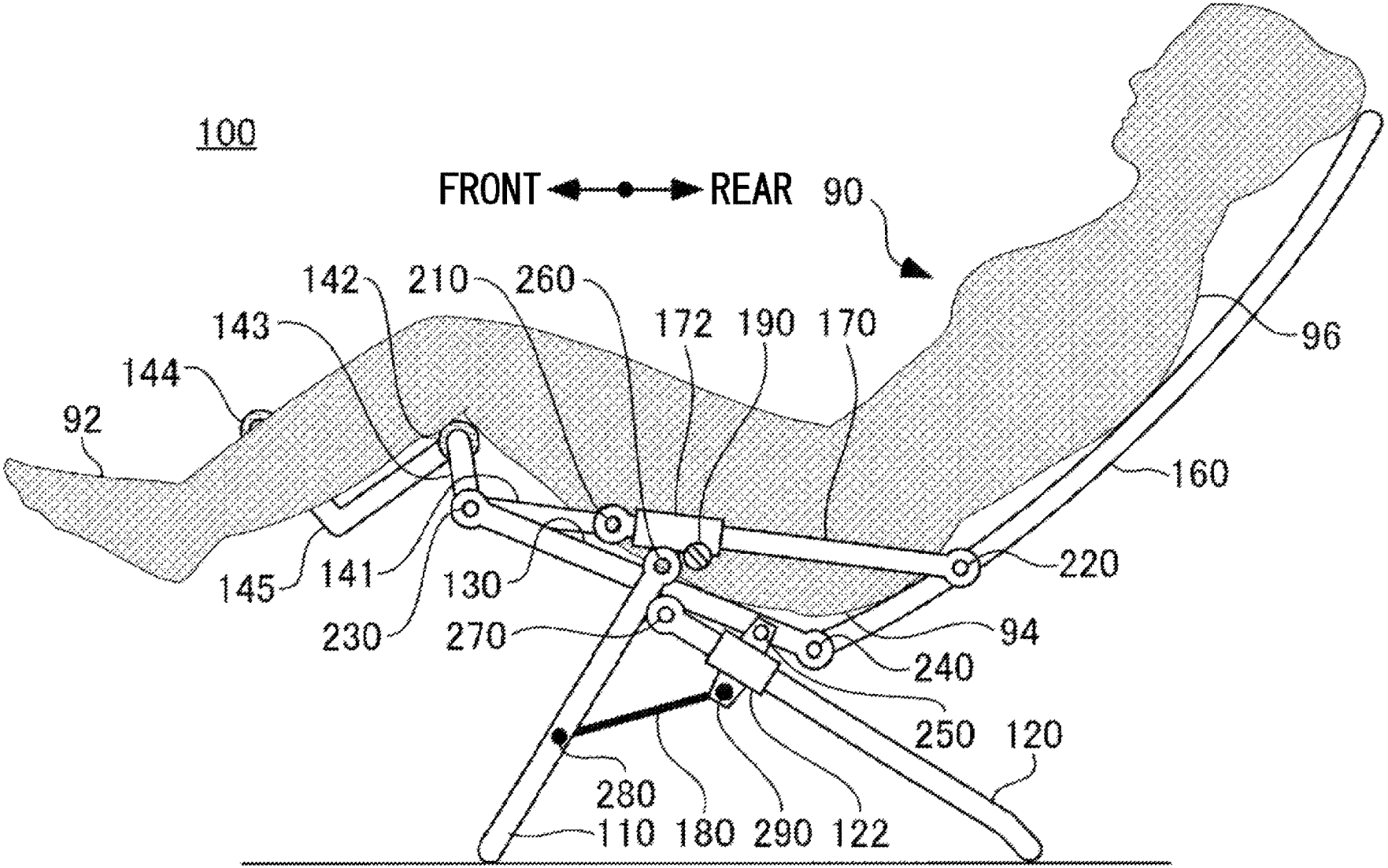
FIG. 4 is a side view of the examination table 100.

FIG. 4 is a side view of the examination table 100. FIG. 4 shows a situation in which the examination table 100 shown in FIG. 1 is changed from the end-sitting positioning state. The examination table 100 shown in FIG. 4 is changed to a lithotomy positioning state. With this change, the body position of the patient 90 supported on the examination table 100 is changed to the lithotomy position.

When the brakes 190 are released in the examination table 100, the upper links 170 can be slided relative to the upper sliders 172. Accordingly, in this state, the backrest 160 coupled to the upper links 170 via the joints 220 can change an angle relative to the seat 130.

Then, when the upper end of the backrest 160 is moved rearward while the brakes 190 are released, the backrest 160 is inclined rearward around the rear joints 240 at the rear end of the seat 130, so that the angle between the seat 130 and the backrest 160 becomes larger. Accordingly, the rearward inclination of the seat 130 increases slightly. With these changes of states, the back of the patient 90 leaning against the backrest 160 is inclined rearward.

Moreover, by the operation described above, the upper links 170 are moved rearward relative to the seat 130, so that the front links 141 are rotated clockwise (in the figure) around the joints 230 at the front end of the seat 130. Thus, the arm parts 143 integrated with the front links 141 are rotated clockwise (in the figure) to raise the horizontal bars 142 provided at the front ends of the arm parts 143.

Before changing the examination table 100 from the end-sitting positioning state to the lithotomy positioning state, the lower limbs 92 of the patient 90 are moved to laterally outside of the joint parts 145. Thus, the raised horizontal bars 142 abut the back of the knees of the patient 90, and serve as abutting parts for lifting the lower limbs 92 of the patient 90 upward.

As described above, when the brakes 190 are released, the examination table 100 can change an inclination of the backrest 160 relative to the seat 130, and, when the inclination of the backrest 160 is changed, an angle of each of the arm parts 143 relative to the seat 130 is changed in association with the change of the angle of the backrest 160. Thus, the examination table 100 is changed from the end-sitting positioning state to the lithotomy positioning state, and the position of the patient 90 placed on the examination table 100 is changed from the end-sitting position to the lithotomy position.

Figure 5:
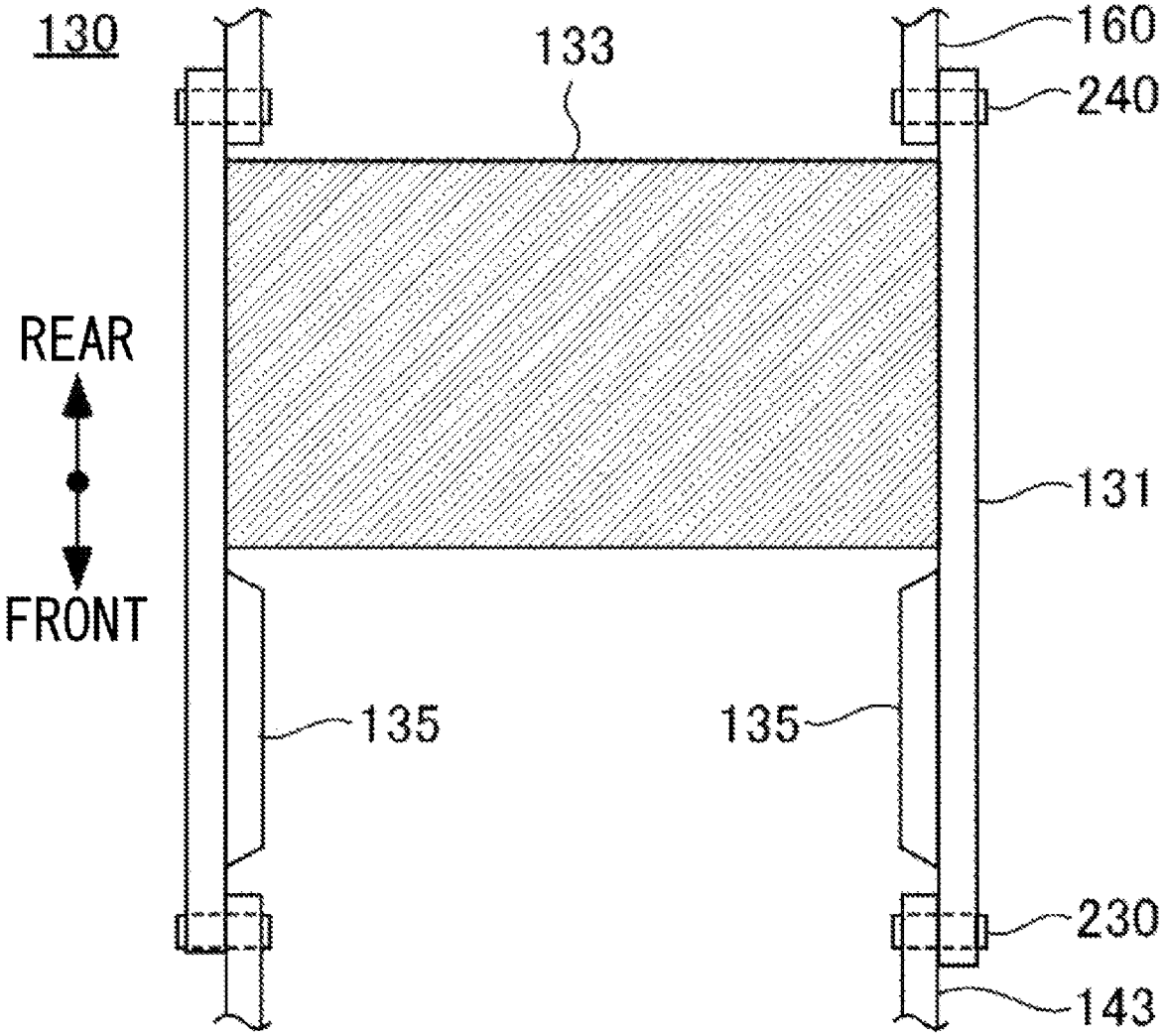
FIG. 5 is a plan view of the seat 130.

FIG. 5 is a plan view of a seat 130. FIG. 5 shows a state in which the detachable seat part 132 is removed from the seat 130. When the detachable seat part 132 is removed, the front part of the seat 130 is opened, so that the lower body of the patient is released. Thus, the examination table 100 that is changed to the lithotomy positioning state can maintain the lithotomy position of the patient placed on the examination table 100 by fixing the upper sliders 172 relative to the upper links 170 with the brakes 190.

Figure 6:
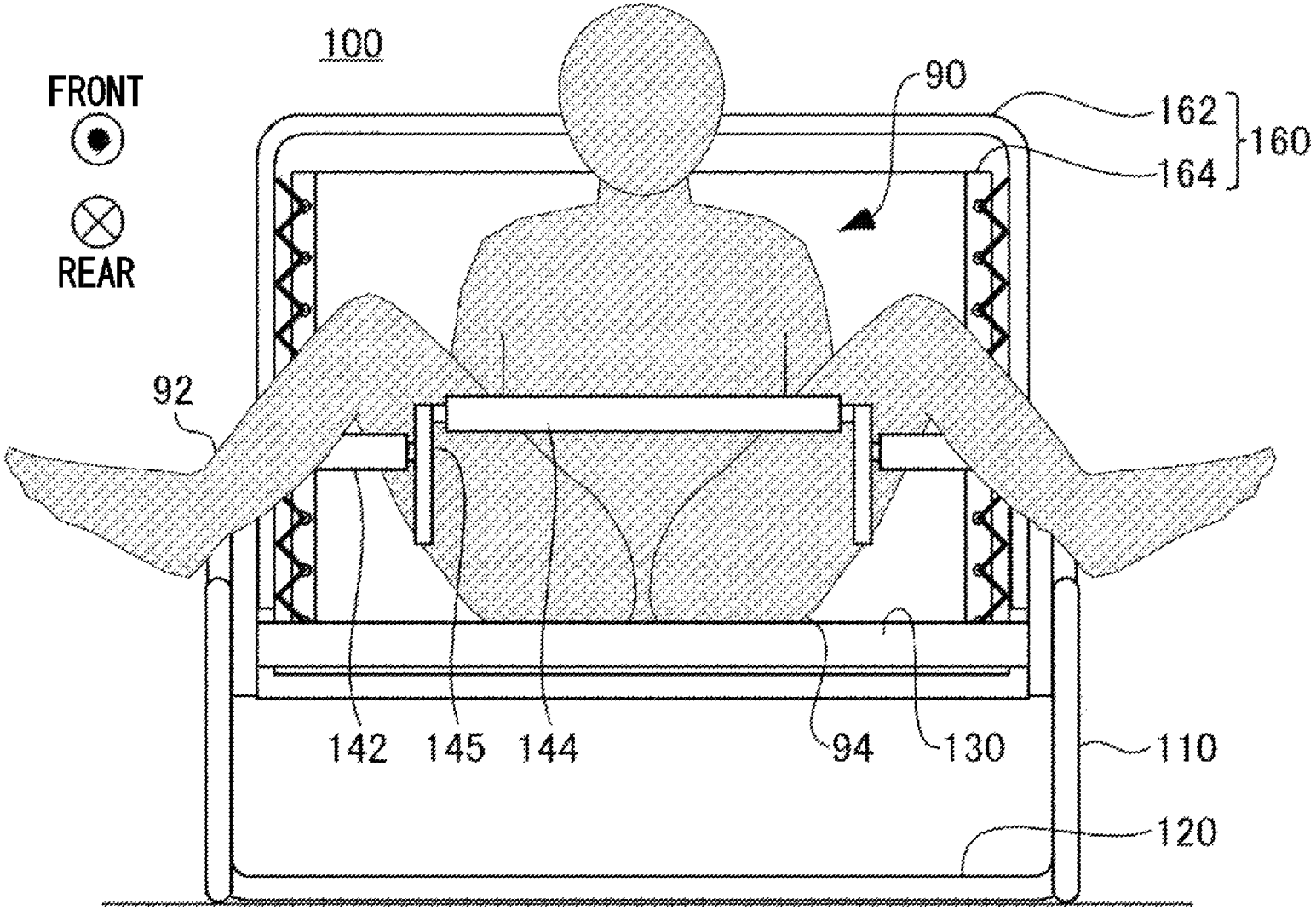
FIG. 6 is a front view of the examination table 100.

FIG. 6 is a front view of the examination table 100. FIG. 6 shows the examination table 100 in the lithotomy positioning state shown in FIG. 5 viewed from the front.

In the examination table 100, a pair of arm parts 143 are provided on the both ends of the examination table 100 in the width direction, avoiding the front of the patient 90. Tips of the pair of arm parts 143 are connected by the horizontal bar 144. With such structure, the examination table 100 can have sufficient strength to support the lower limbs 92 of the patient 90 by using a light weight material.

Note that, unlike the seat 130 and the backrest 160, no hammock part 164 is provided in the region surrounded by the pair of arm parts 143 and the horizontal bar 144. Therefore, no obstruction exists in the front of the lower body of the patient 90 in the lithotomy position. Thus, it becomes easier to examine and perform an operation to the lower body of the patient 90 and, for the patient 90, easier to receive a medical check.

Moreover, the horizontal bars 142 are provided at the end tips of the pair of right and left arm parts 143 on farther side from the seat 130. When the arm parts 143 are rotated relative to the seat 130, the horizontal bars 142 are raised to directly abut and push up the back of the knees of the patient 90. Moreover, as for the examination table 100 in the lithotomy positioning state, the horizontal bars 142 support the lower limbs of the patient 90. Therefore, in order to avoid discomfort of the patient 90 when any force is applied onto the patient 90, the horizontal bars 142 are preferably covered with an elastic material.

Figure 7:
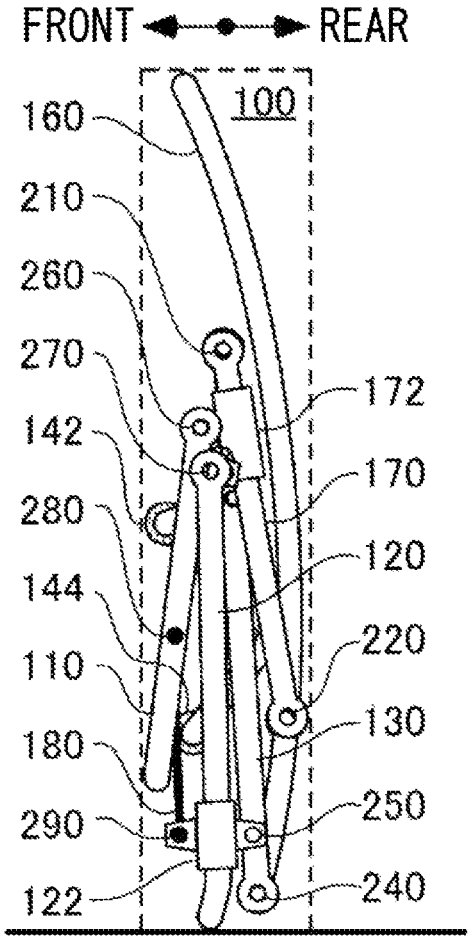
FIG. 7 is a side view of the examination table 100.

FIG. 7 is a side view of the examination table 100. FIG. 7 shows a situation in which the state of the examination table 100 is further changed. The examination table 100 shown in FIG. 7 is in a folded state.

As already described, when the brakes 190 are released in the examination table 100, the upper links 170 can be slided relative to the upper sliders 172. Thus, when the brakes 190 are released, an angle of the backrest 160 coupled to the upper links 170 via the joints 220 relative to the seat 130 can be changed. When the examination table 100 is changed to the folded state, an angle between the seat 130 and the backrest 160 is further smaller than that in the end-sitting positioning state.

Thus, as the backrest 160 is moved closer to the front of the examination table 100, the seat 130 is pulled relatively rearward. When the seat 130 is pulled rearward, the front leg 110 coupled via the joints 260 and the lower sliders 122 coupled via the joints 250 are rotated with the displacement of the seat 130. Further, because the front leg 110 and the rear leg 120 are coupled by the lower links 180, angles between the front leg 110, the rear leg 120 and the seat 130 are narrowed, so that the dimension of the entire leg part is reduced.

By the series of deformations, as for the examination table 100 in the folded state, the backrest 160 is displaced forward and the spacing between the seat 130, the front leg 110 and the rear leg 120 is narrowed. Accordingly, the dimension of the entire examination table 100 in the folded state is significantly smaller than that in the end-sitting positioning state and the lithotomy positioning state, as shown in FIG. 7 by a dotted line. Thus, the examination table 100 can be carried not only by a special vehicle such as an ambulance or a freight vehicle but also by a common passenger car. Thus, in a case of a disaster, an accident, a home birth or the like, the examination table 100 is easy to bring to the site, so that position-keeping of the patient 90 and sanitation control level can be improved. Moreover, it becomes easy for doctors and nurses to perform an operation.

Note that, depending on usages, a bag or a cover may be prepared for airtight storage of the portable examination table 100 as described above. By storing a sterilized examination table 100 in the folded state in such bag or cover, the examination table 100 can be quickly used when the situation is pressing. Moreover, for easier carriage of the examination table 100, a wheeled carrier may be prepared or alternatively a wheel that can be used for the examination table 100 itself in the folded state may be provided.

Figure 8:
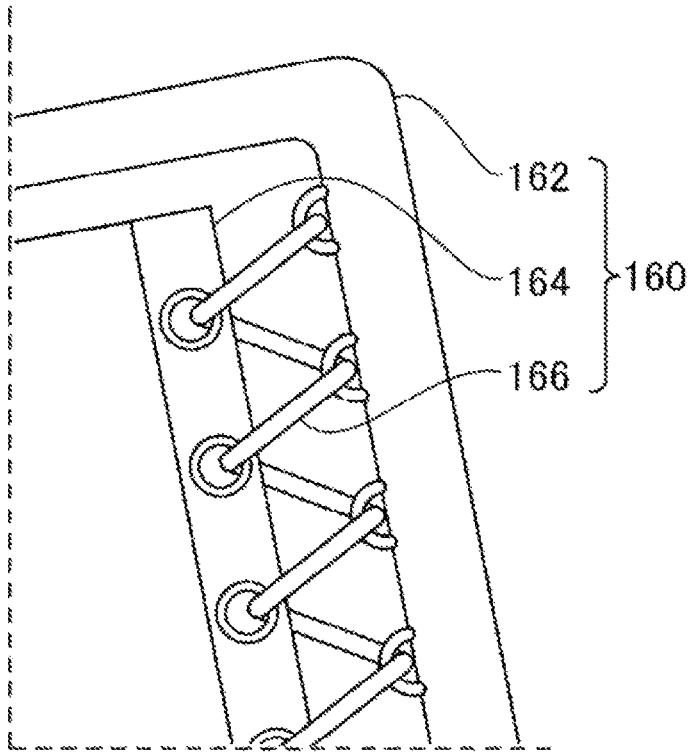
FIG. 8 is a partially enlarged view of a backrest 160.

FIG. 8 is a partially enlarged view of the examination table 100. FIG. 8 shows an upper-right portion (in FIG. 7) of the backrest 160 of the examination table 100 in an enlarged view.

As shown, in the examination table 100, the backrest 160 has a frame part 162 and a hammock part 164. The frame part 162 is provided surrounding a region of the backrest 160 for contacting with the body of the patient 90. The frame part 162 can be formed of, for example, a metal tube material to satisfy needs for strength and light weight.

The hammock part 164 is formed by a sheet member stretched across the inside of the frame part 162, for example, a canvas fabric, a nylon net, a reinforced rubber mat, a sand free sheet or the like. The hammock part 164 is connected to the frame part 162 by a laced string 166. A thin braided or small diameter rope or the like may be used as the laced string 166. Moreover, a detachable fastener such as a surface fastener or a hook may be used to make the hammock part 164 detachable.

Thus, after using the examination table 100, the hammock part 164 can be removed to be washed or sterilized. Moreover, the used hammock part 164 may be disposed each time and a new hammock part 164 may be applied. Thus, the examination table 100 can always be used in a clean state. In the examination table 100, the structure of the backrest 160 described above may be also applied to the seat 130.

Figure 9:
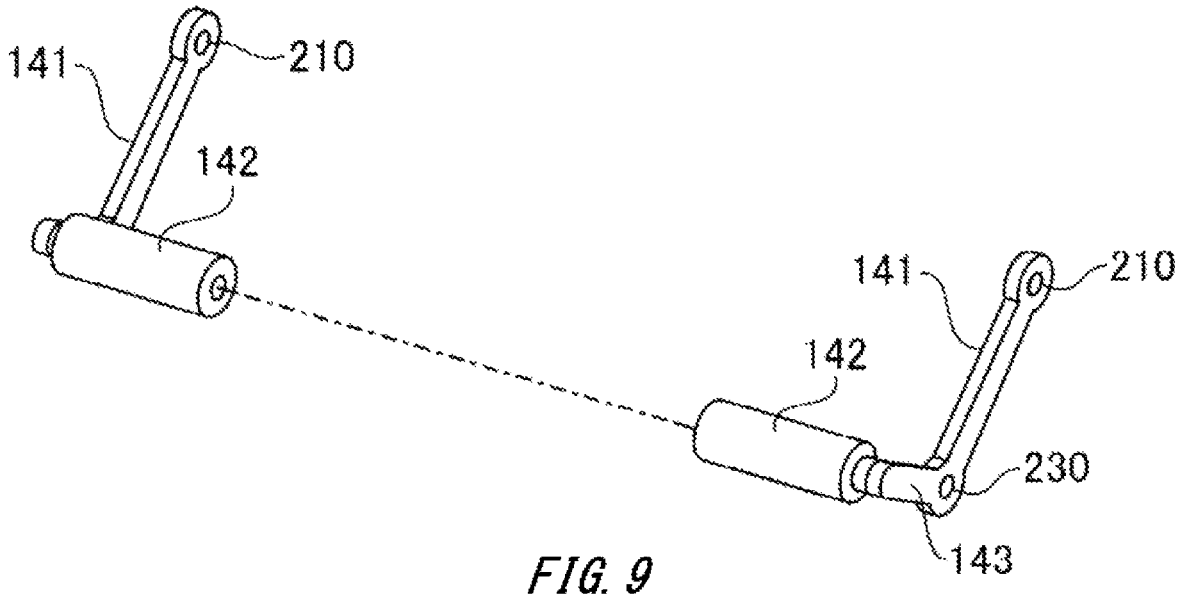
FIG. 9 is a view showing another form of the horizontal bar 144.

FIG. 9 is a perspective view showing an exemplary member that can be used instead of the front assembly 140 shown in FIG. 2. The member shown in FIG. 9 has the same shape as the front assembly 140 shown in FIG. 2, except that the central horizontal bar 144 and the pair of joint parts 145 are eliminated. By attaching the member shown in FIG. 9, instead of the front assembly 140, to the examination table 100, the patient does not need to step over the horizontal bar 144 when sitting down on the examination table 100 in the end-sitting positioning state.

Figure 10:
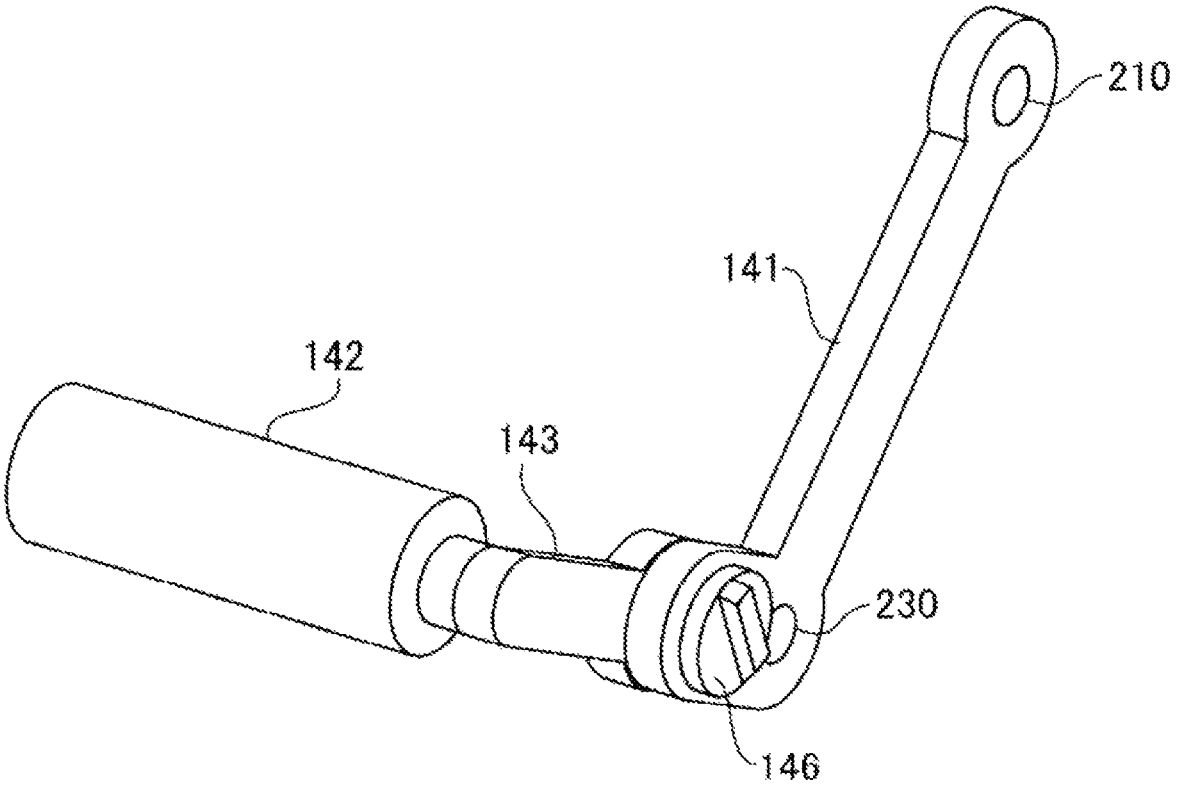
FIG. 10 is a view showing yet another form of the horizontal bar 144.

FIG. 10 is a view showing yet another form of the front assembly 140 shown in FIG. 9. FIG. 10 shows only one side of the front assembly 140 on the right-hand side (in the figure) in an enlarged view.

In the member shown in FIG. 10, the arm part 143 is connected to the front link 141 via a joint that is formed by a lock screw 146 and different from the joint 230. The lock screw 146 is inserted through a hole formed in the front link 141, and a tip of the lock screw 146 is screwed into a screw hole formed in the arm part 143. Thus, a mid part of the lock screw 146 serves as a rotation axis when the arm part 143 is rotated relative to the front link 141.

Moreover, when the lock screw 146 is tightened, the arm part 143 is pulled toward a side surface of the front link 141. Thus, teeth formed on opposing surfaces of the front link 141 and the arm part 143 are engaged, so that rotation of the arm part 143 relative to the front link 141 is prevented. When the lock screw 146 is loosened, the teeth of the front link 141 and the arm part 143 are disengaged, so that the arm part 143 is easily rotated relative to the front link 141. Thus, a position at which the horizontal bar 142 abuts the patient can be adjusted.

Note that the structure of the connecting part of the front link 141 and the arm part 143 is not limited to the structure described above. For example, a ratchet structure may be used in which the arm part 143 is rotated relative to the front link 141 and the rotation is locked at any position upon releasing the hand from the arm part 143. Moreover, another structure may be used in which a member providing a plurality of arm parts 143 having different dimensions is prepared and exchanged.

Figure 11:
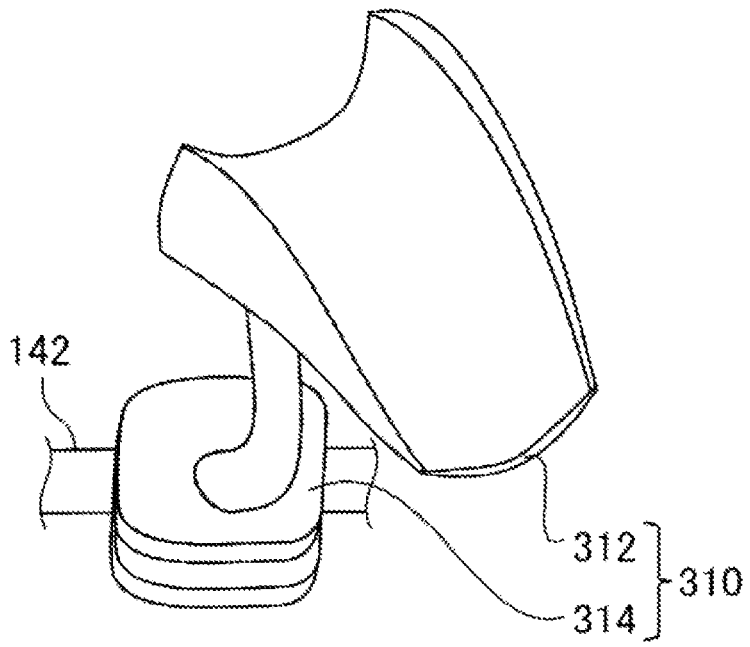
FIG. 11 is a perspective view of a lower limb support attachment 310.

FIG. 11 is a partially enlarged view of the examination table 100. FIG. 11 shows a state in which a detachable lower limb support attachment 310 is attached near a tip of the arm part 143 of the examination table 100.

The lower limb support attachment 310 has a knee back support part 312 and a clamp part 314. A top surface of the knee back support part 312 has a shape following the shape of the back of the knees of the patient 90 in the lithotomy position. The clamp part 314 can clamp a part near the tip of the arm part 143 of the examination table 100 and be fixed relative to the examination table 100. Moreover, the clamp part 314 supports the knee back support part 312 from below at the height suitable for performing an operation. By attaching such lower limb support attachment 310 to the examination table 100, the lower limbs of the patient 90 in the lithotomy position can be lifted higher, so that the position suitable for delivery or the like can be maintained.

Note that an attachment that can be attached to the examination table 100 is not limited to the lower limb support attachment 310 described above. For example, an armrest attachment may be prepared, which is attached to the top surface of the upper link 170 for supporting an arm of the patient. Moreover, still another attachment may be prepared, such as a grip attachment that is attached to the upper end of the backrest 160 for the patient 90 to grip.

Figure 12:
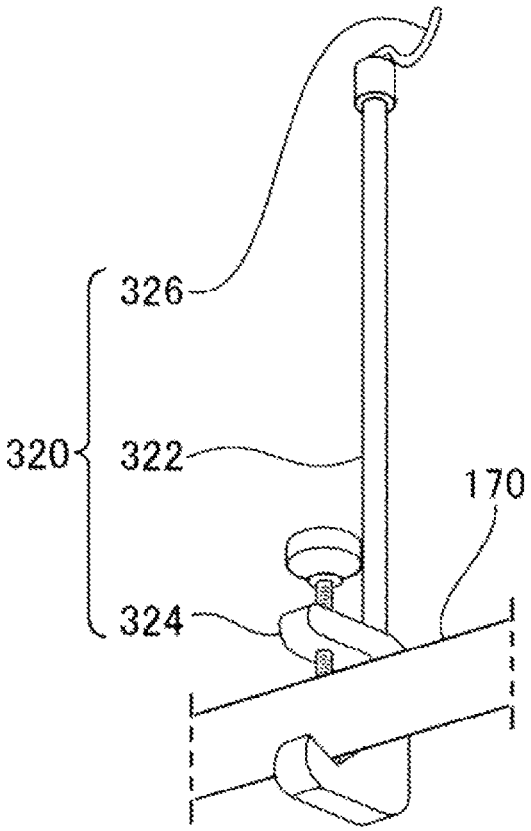
FIG. 12 is a perspective view of an infusion attachment 320.

FIG. 12 is a partially enlarged view of the examination table 100. FIG. 12 shows a situation in which an infusion attachment 320 is attached to the examination table 100, as another exemplary attachment that can be provided on the examination table 100.

The infusion attachment 320 has an infusion bar 322 and a clamp part 324. At its upper end, the infusion bar 322 has a hook for hanging an infusion pack (not shown). Moreover, the infusion bar 322 has a height sufficient for dropping liquid medicine. The clamp part 324 is attached to any of the upper link 170, the seat 130, the front leg 110 or the like or a plurality of side surfaces of the examination table 100 and fixes the infusion bar 322 to the examination table 100.

Attaching such infusion attachment 320 to the examination table 100 can eliminate a need for personnel to hold the infusion pack, so that personnel on the site can concentrate on the treatment of the patient 90. In other cases, a measurement device such as a vital signs monitor or the like, a cylinder for respiratory assistance or the like, or medical equipment such as equipment for a patient to call a nurse can be fixed to the examination table 100.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

90: patient, 92: lower limb, 94: bottom, 96: back, 100: examination table, 110: front leg, 120: rear leg, 122: lower slider, 130: seat, 131: frame, 132: detachable seat part, 133: fixed seat part, 135: support rib, 137: detachable frame, 139: cushion part, 140: front assembly, 141: front link, 142, 144: horizontal bar, 143: arm part, 145: joint part, 146: lock screw, 160: backrest, 162: frame part, 164: hammock part, 166: laced string, 170: upper link, 172: upper slider, 180: lower link, 190: brake, 210, 220, 230, 240, 250, 260, 270, 280, 290: joint, 310: lower limb support attachment, 312: knee back support part, 314, 324: clamp part, 320: infusion attachment, 322: infusion bar.

What is claimed is:

1. A portable examination table comprising:

a seat part for supporting a bottom of a patient, the seat part being positioned relative to a floor by a leg part having a plurality of legs, a backrest part for supporting a back of the patient, the backrest part being provided at one end of the seat part and capable of changing an angle relative to the seat part, a pair of arm parts capable of changing an angle relative to the seat part, the pair of arm parts being provided at another end of the seat part avoiding the front of the patient leaning his/her back against the backrest part, abutting parts configured to couple end portions of the pair of arm parts at farther ends from the seat part, and to be raised or lowered when the angle of the pair of arm parts relative to the seat part is changed and abut the back of the knees of the patent when raised, the abutting parts including, with respect to each of the pair of arm parts:

a front link linked to the backrest part, wherein the arm part is connected to a first horizontal bar, and the first horizontal bar is connected to a second horizontal bar, movement of the backrest part causes the arm part to mechanically lift the first horizontal bar and the second horizontal bar, and link parts configured to, when the angle of the backrest part relative to the seat part is changed, link the pair of arm parts with the backrest part and change the angle of the pair of arm parts relative to the seat part, wherein the portable examination table is configured to convert between:

an end-sitting positioning state in which the backrest part is erected relative to the seat part so that the patient seated on the seat part is in an end-sitting position, a lithotomy positioning state in which the backrest part is reclined and the abutting parts lifted by the pair of arm parts linked with the backrest part via the link parts lift the back of the knees of the patient, so that the patient is in a lithotomy position, and a folded state in which the angle between the seat part and the backrest part is smaller than in the end-sitting positioning state so that the entire dimension of the portable examination table is smaller than that in the end-sitting positioning state.

2. The portable examination table according to claim 1, further comprising:

a linkage configured to, when the portable examination table is converted to the folded state, narrow at least part of a gap between the plurality of legs and reduce the dimension of entire leg part compared to that in the end-sitting positioning state and the lithotomy positioning state.

3. The portable examination table according to claim 1, wherein, in at least one of the seat part and the backrest part, a portion for contacting with a body of the patient is detachable.

4. The portable examination table according to claim 1, wherein at least one of the seat part and the backrest part has a frame part surrounding a region for contacting with a body of the patient and a sheet detachably stretched across the frame part.

5. The portable examination table according to claim 1, further comprising an attachment part for attaching a medical peripheral.

6. The portable examination table according to claim 1, wherein:

the front link is connected at opposite ends to a first joint and to a second joint, the first joint being connected to an end portion of an upper link connected to the backrest part, the arm part is connected at opposite ends between the second joint and the first horizontal bar, a joint part connects the first horizontal bar to the second horizontal bar, and the upper link is connected to the first joint to cause the arm part to rotate about the second joint so as to mechanically lift the first horizontal bar and the second horizontal bar.

7. The portable examination table according to claim 1, wherein:

the front link is fixed at an angle to the arm part.

8. The portable examination table according to claim 7, wherein:

the front link is connected at opposite ends to a first joint and to a second joint, the first joint being connected to an end portion of an upper link connected to the backrest part, the arm part is connected at opposite ends between the second joint and the first horizontal bar, a joint part connects the first horizontal bar to the second horizontal bar, and the upper link is connected to the first joint to cause the arm part to rotate about the second joint so as to mechanically lift the first horizontal bar and the second horizontal bar.

* * * * *